United States Patent [19]

Tobias et al.

[11] Patent Number: 4,818,389

[45] Date of Patent: Apr. 4, 1989

[54] SKIMMER WITH FLOW ENHANCER

[75] Inventors: Samuel Tobias, Edison; Thomas Pinelli, Saddle Brook; Robert M. Messinger, Cranford; Fred T. Hazlehurst, Roselle Park, all of N.J.

[73] Assignee: Hayward Industries, Inc., Elizabeth, N.J.

[21] Appl. No.: 140,049

[22] Filed: Dec. 31, 1987

[51] Int. Cl.[4] ..... E04H 3/20; F04F 5/48

[52] U.S. Cl. ..... 210/169; 210/416.2; 4/490; 4/507; 417/87; 417/178; 417/186

[58] Field of Search ..... 210/416.2, 169; 417/87, 417/151, 160, 178, 182, 186, 190; 4/490, 507, 508, 509, 512

[56] References Cited

U.S. PATENT DOCUMENTS 4,501,659 2/1985 Henk ..... 210/169

*Primary Examiner*—Richard V. Fisher
*Assistant Examiner*—Christopher Upton
*Attorney, Agent, or Firm*—Ralph W. Selitto, Jr.

[57] ABSTRACT

A skimmer for skimming water from a swimming pool or spa is provided with entraining means for entraining additional water from the pool or spa to thereby increase the flow of water into and out of the skimmer. The entraining means includes two nozzle members which cooperate with each other to jet an entraining stream of water through the skimmer. The skimmer is also provided with isolating means for isolating the entraining stream of water from the rest of the water flowing through the skimmer. The isolating means includes actuating means for selectively actuating and deactuating the isolating means such that the skimmer can be operated at a normal flow rate when the isolating means is actuated and at an increased flow rate when the isolating means is deactuated.

24 Claims, 11 Drawing Sheets

SKIMMER WITH FLOW ENHANCER

FIELD OF THE INVENTION

The present invention relates to skimmer assemblies for swimming pools, spas and the like, and, more particularly, to such assemblies which are adapted to enhance the flow of water therethrough.

BACKGROUND OF THE INVENTION

A conventional swimming pool or spa installation usually employs a pump and filter located adjacent to the pool or spa for the purpose of recirculating and filtering the pool or spa water. Typically, a skimmer assembly is installed in or on the wall of the pool or spa in order to skim off the upper surface of the pool or spa water before the water is circulated to the pump and filter.

Many skimmer assemblies are designed for use in a vacuuming mode as well as in a skimming mode. In a skimming mode, a strainer basket is employed to remove coarse debris which may be floating on top of the water. In a vacuuming mode, the strainer basket is usually removed and a vacuum hose is attached to the skimmer assembly. If it is desired to enhance the skimming and/or vacuuming action of these skimmer assemblies, the normal approach would be to increase the capacity of the pump to thereby increase the flow rate through the skimmer assembly. This approach is, however, disadvantageous because it increases manufacturing costs as well as operating costs due to the larger capacity pump which must be utilized.

Henk U.S. Pat. No. 4,501,659 discloses a skimmer apparatus which enhances the skimming operation by increasing flow through the skimmer apparatus. Such increased flow is achieved by using the output from the pool filter as an ejector. Although this prior art skimmer apparatus does function effectively to enhance the skimming operation, its utility is limited to the performance of a skimming operation because it is totally incapable of operating in a vacuuming mode.

SUMMARY OF THE INVENTION

In accordance with the present invention, a skimmer for skimming water from a swimming pool or spa is provided with entraining means for entraining additional water from the pool or spa to thereby increase the flow of water into and out of the skimmer. The entraining means includes two nozzle members which cooperate with each other to jet an entraining stream of water through the skimmer. The skimmer is also provided with isolating means for isolating the entraining stream of water from the rest of the water flowing through the skimmer. The isolating means is selectively actuated and deactuated such that the skimmer can be operated at a normal flow rate when the isolating means is actuated and at an increased flow rate when the isolating means is deactuated. By increasing the flow rate of the skimmer, improved skimming and circulation of the pool or spa water can be acheived. The ability to isolate the entraining stream of water from the rest of the water in the skimmer also permits the skimmer to be used in a vacuuming mode as well as in a skimming mode.

BRIEF DESCRIPTION OF THE DRAWINGS

For a better understanding of the present invention, reference is made to the following description of three exemplary embodiments considered in conjunction with the accompanying drawings, in which.

DESCRIPTION OF THE EXEMPLARY EMBODIMENTS

Figure 1:
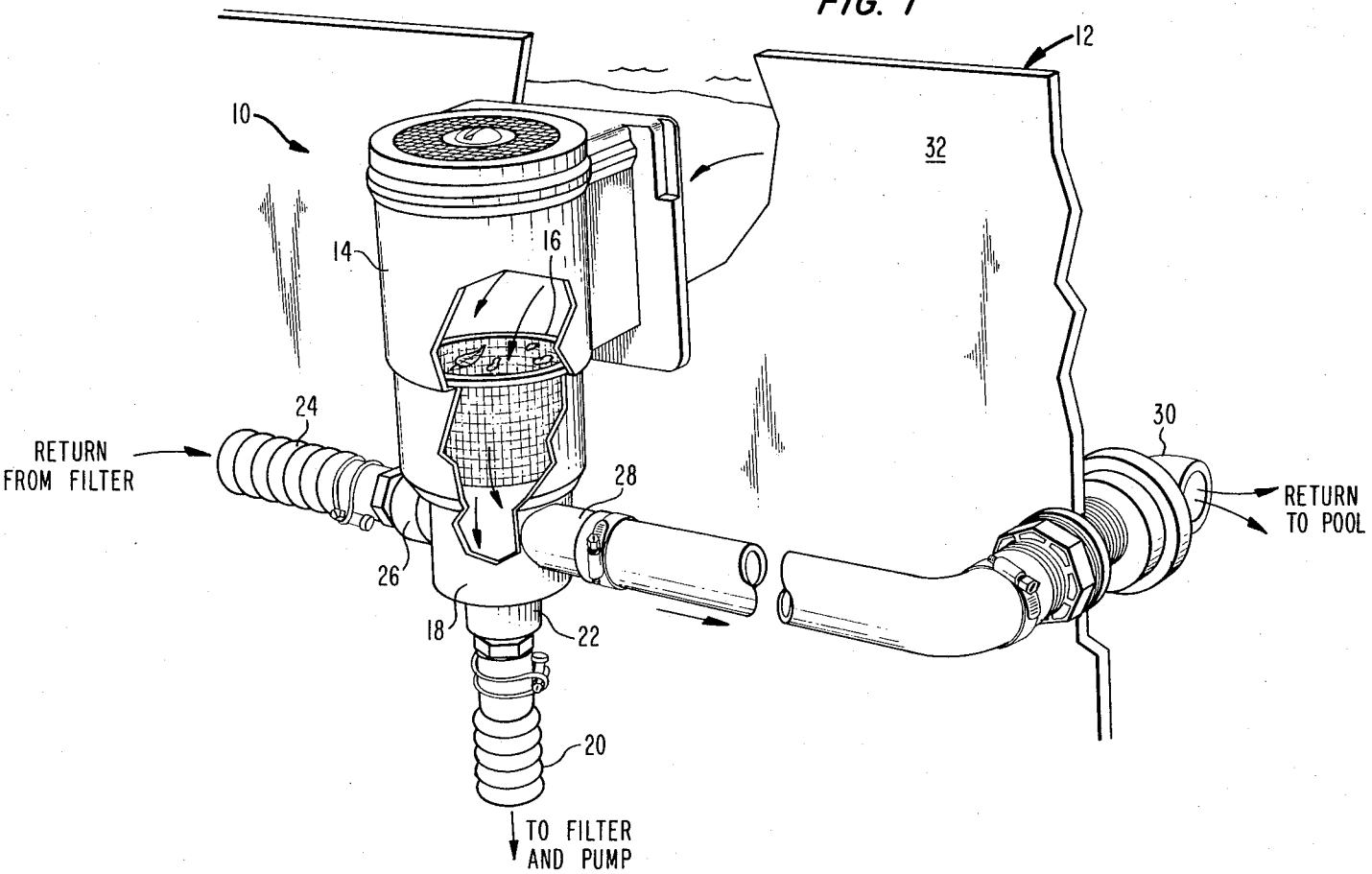
FIG. 1 is a perspective view of a skimmer system equipped with a booster valve constructed in accordance with the present invention, portions of the skimmer system being broken away to facilitate consideration and discussion.

Referring to FIG. 1, a skimmer system 10 for a swimming pool or spa 12 includes a skimmer housing 14 which receives a removable strainer basket 16. A valve body 18, which will be described in greater detail below, depends from the skimmer housing 14. A hose 20 connects an outlet 22 on the bottom of the valve body 18 to an inlet of a filter and pump combination (not shown), while another hose 24 connects an outlet of the filter and pump combination to a nozzle inlet fitting 26 on one side of the valve body 18. The opposite side of the valve body 18 has a nozzle outlet fitting 28 which is connected to a directional return outlet 30 mounted in a wall 32 of the pool or spa 12.

With reference to FIGS. 2–6, the valve body 18 defines a cylindrical interior chamber 34 which communicates, on one side, with a tapered passageway 36 extending through the nozzle inlet fitting 26 and which communicates, on an opposite side, with a tapered passageway 38 extending through the nozzle outlet fitting 28. The passageway 36 is tapered in such a manner that water flowing through the nozzle inlet fitting 26 is caused to converge as it travels toward the chamber 34 of the valve body 18, while the passageway 38 is tapered in such a manner that water flowing through the nozzle outlet fitting 28 is allowed to diverge as it travels away from the chamber 34 of the valve body 18. The relative cross-sectional shapes and sizes of the passageways 36, 38 are selected so as to create a venturi effect on the water flowing from the nozzle inlet fitting 26 to the nozzle outlet fitting 28. Thus, the nozzle inlet fitting 26 and the nozzle outlet fitting 28 cooperate to form a venturi nozzle system.

A rotating, diverter-type booster valve 40 (see FIG. 3) is removably received in the chamber 34 of the valve body 18. The booster valve 40 includes an upper portion 42 having an outside diameter which is substantially the same as the diameter of the chamber 34 of the valve body 18. A circular groove 44 extends around the upper portion 42 of the booster valve 40, the groove 44 being provided with radially spaced-apart openings 46. The groove 44 releasably receives lugs 48 which extend radially inwardly from resilient fingers 50 formed in an upper edge 52 of the valve body 18 (see FIG. 2). The lugs 48 cooperate with the groove 44 to fix the vertical position of the booster valve 40 relative to the valve body 18, while also cooperating with the openings 46 to fix the radial orientation of the booster valve 40 relative to the valve body 18. The upper portion 42 of the booster valve 40 is also provided with operating tabs 54 which extend radially outwardly therefrom a distance sufficient to permit them to function as handles for the purpose of manually rotating the booster valve 40 between a booster-on position (see FIGS. 2 and 4) and a booster-off position (see FIGS. 5 and 6). A symbol 56, such as an arrow, is provided on one side of tabs 54 in order to indicate the operating mode of the booster valve 40 (see FIGS. 3, 4 and 5).

The booster valve 40 also includes a lower portion 58 having an outside diameter which is less than the outside diameter of the upper portion 42. A nozzle inlet extension 60 protrudes radially outwardly from one side of the lower portion 58 of the booster valve 40, while also protruding radially inwardly into an interior channel 64 which extends through the booster valve 40. Similarly, a nozzle outlet extension 62 protrudes radially outwardly from an opposite side of the lower portion 58 of the booster valve 40, while also protruding radially inwardly into the interior channel 64 of the booster valve 40. The lower portion 58 of the booster valve 40 also includes a radially outwardly extending flange 66 which sits on a floor 68 of the valve body 18 when the lugs 48 of the resilient fingers 50 are engaged in the groove 44 provided in the upper portion 42 of the booster valve 40. The flange 66 has a diameter which is substantially the same as the diameter of the chamber 34 of the valve body 18.

Figure 2:
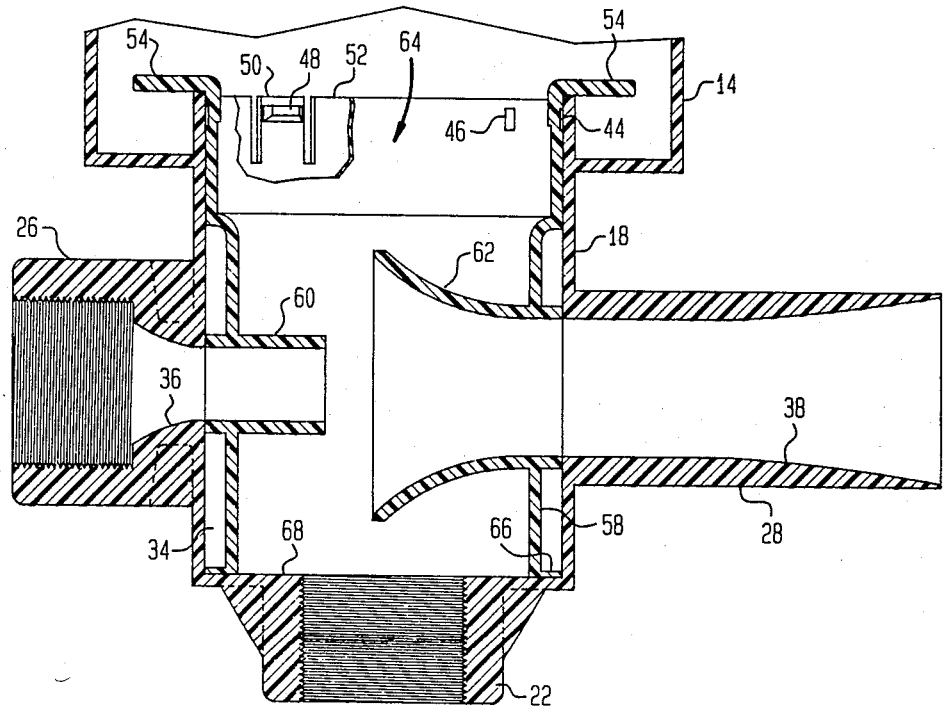
FIG. 2 is a cross-sectional view of a skimmer equipped with a booster valve constructed in accordance with one embodiment of the present invention, a portion of the booster valve being broken away to facilitate consideration and discussion.
Figure 3:
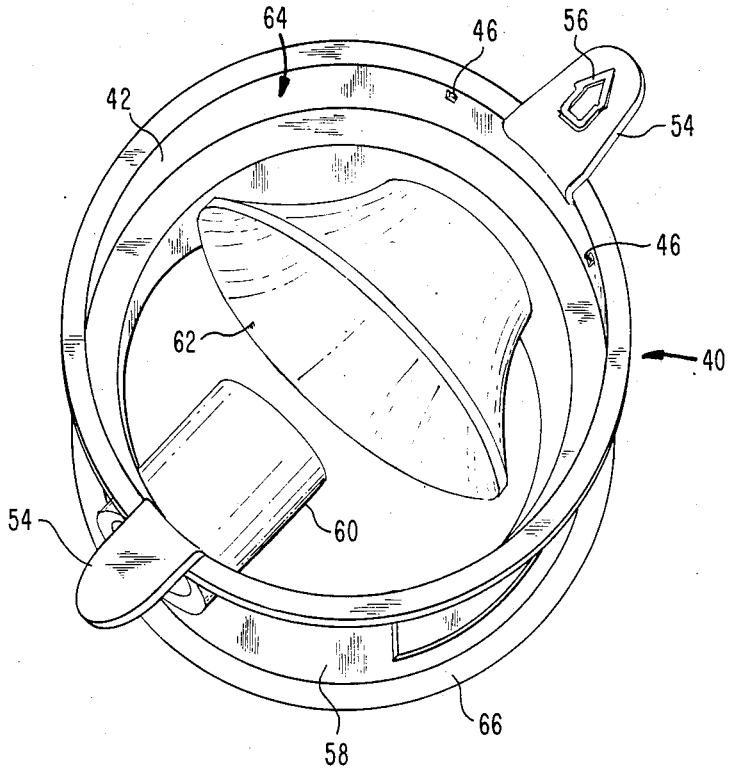
FIG. 3 is a perspective view of the booster valve illustrated in FIG. 2.
Figure 4:
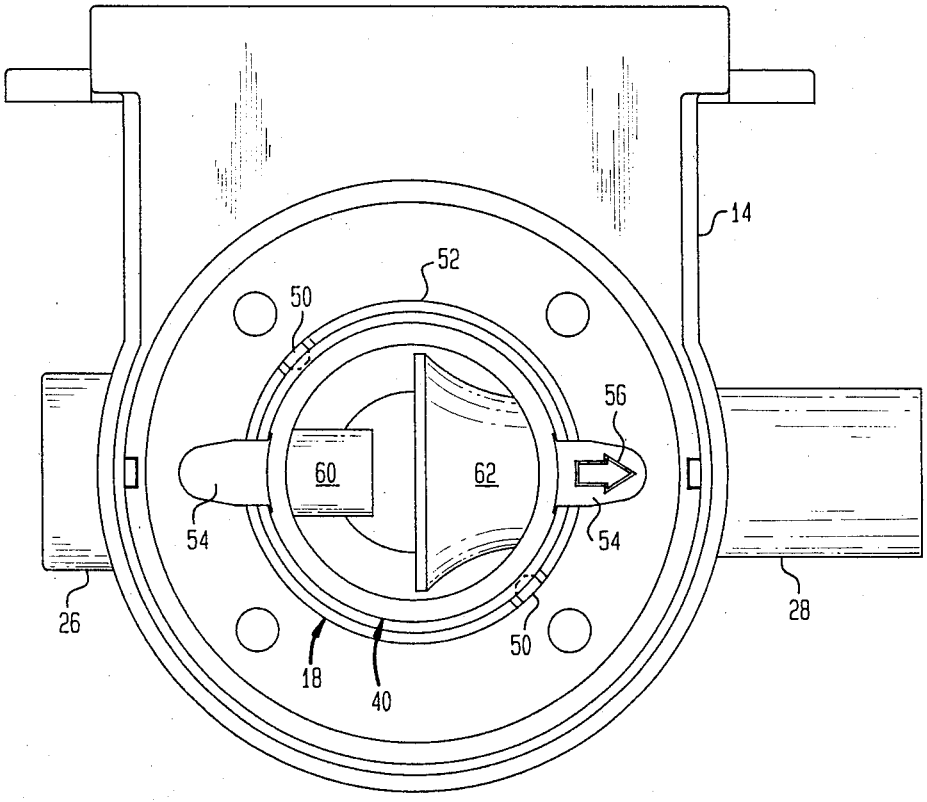
FIG. 4 is a top plan view of the skimmer illustrated in FIG. 2, the booster valve being shown in a booster-on position.
Figure 5:
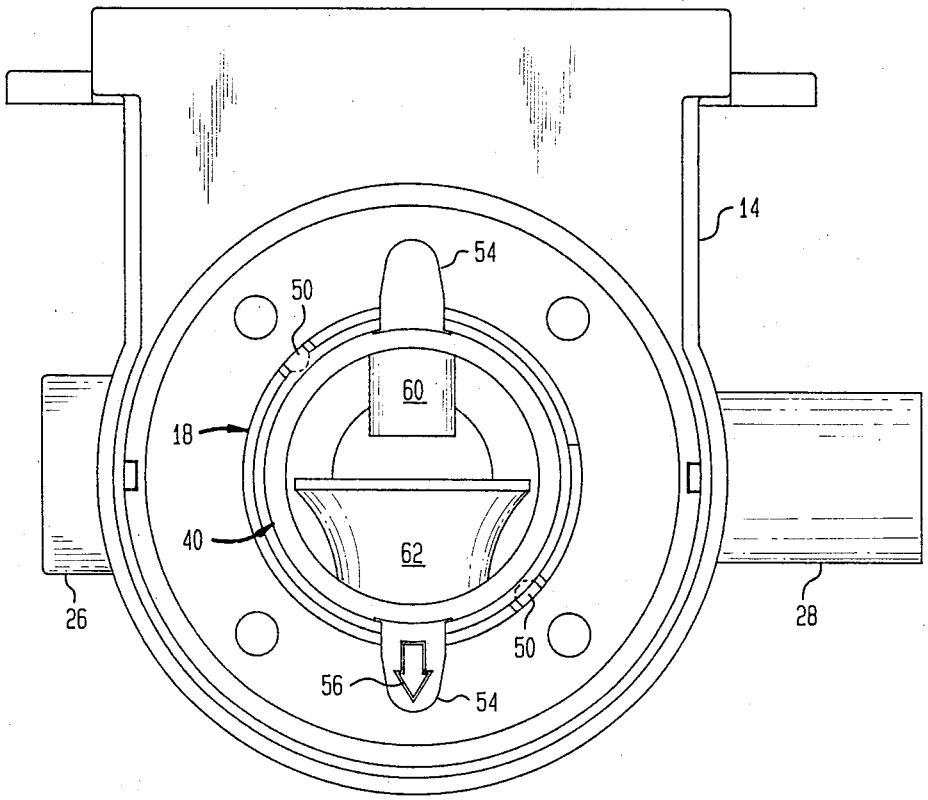
FIG. 5 is a top plan view of the skimmer illustrated in FIG. 2, the booster valve being shown in a booster-off position.

When the booster valve 40 is in its booster-on position (see FIGS. 2 and 4), the nozzle inlet extension 60 receives water from the passageway 36 of the nozzle inlet fitting 26 and directs the water into the nozzle outlet extension 62 (see FIG. 2). The internal convergently tapered shape of the nozzle outlet extension 62 smoothly converges and directs the flow of water into the passageway 38 of the nozzle outlet fitting 28 (see FIG. 2), thereby increasing the operating efficiency of the venturi nozzle system formed by the nozzle inlet fitting 26 and the nozzle outlet fitting 28. More particularly, the nozzle inlet fitting 26 and the nozzle outlet fitting 28 cooperate to create a high velocity flow of water, resulting in a low-pressure venturi action which entrains additional pool or spa water through the skimmer housing 14 and draws it into the chamber 34 of the valve body 18. The entrained water increases the flow into and through the skimmer housing 14, thereby enhancing the skimming operation. The increased flow through the skimmer housing 14 results in a corresponding increase in the flow of water discharged from the return outlet 30, thereby enhancing the circulation of the water contained in the pool or spa 12. Because such enhanced skimming and circulation are achieved without having to increase the capacity of the pump, they do not add to the operating cost of the skimmer system 10.

Figure 6:
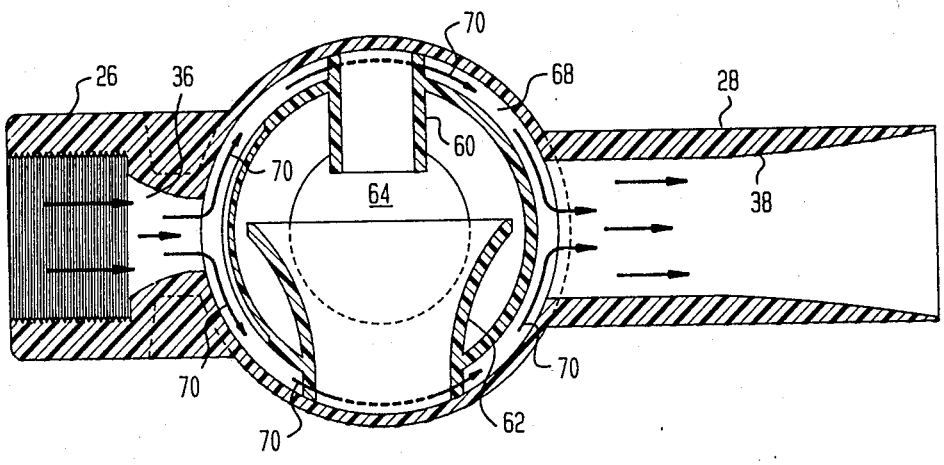
FIG. 6 is a cross-sectional view of the skimmer illustrated in FIG. 5, arrows being used to indicate the flow path of water when the booster valve is in its booster-off position.

When the booster valve 40 is in its booster-off position (see FIGS. 5 and 6), the lower portion 58 of the booster valve 40 forms an annular channel 70 between the valve body 18 and the booster valve 40 (see FIG. 6). The channel 70 communicates, on one side, with the passageway 36 of the inlet nozzle fitting 26 and, on an opposite side, with the passageway 38 of the outlet nozzle fitting 28, thereby creating a flow path indicated by arrows 72 in FIG. 6. Because the channel 70 is isolated from the channel 64 and hence the water flowing therethrough, the venturi nozzle system formed by the nozzle inlet fitting 26 and the nozzle outlet fitting 28 is bypassed to thereby avoid the entrainment of additional pool or spa water.

When the skimmer system 10 is used to perform a pool or spa skimming operation, the booster valve 40 may be set in its booster-on position or in its booster-off position. However, when the skimmer system 10 is used to perform a pool or spa vacuuming operation, the booster valve 40 must be set in its booster-off position in order to prevent some of the dirt and fine particles from being returned to the pool or spa 12 without passing through the filter.

Figure 7:
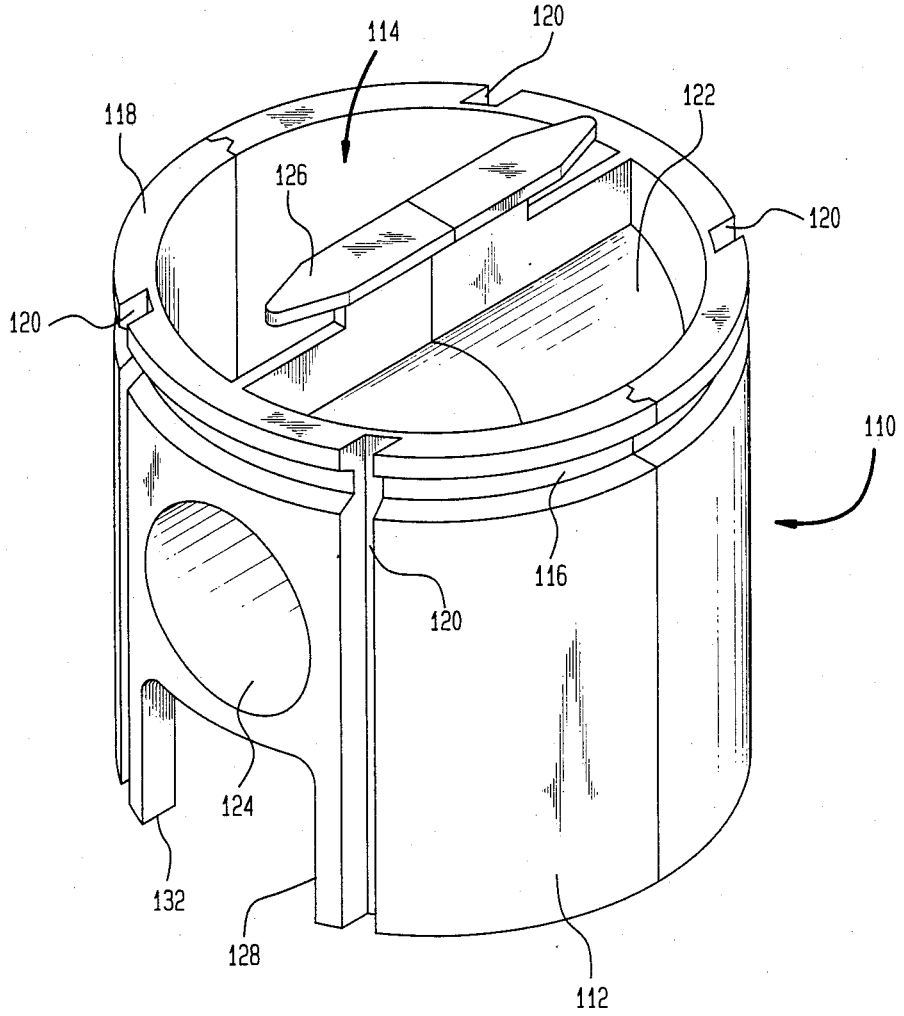
FIG. 7 is a perspective view of a booster valve constructed in accordance with another embodiment of the present invention.
Figure 8:
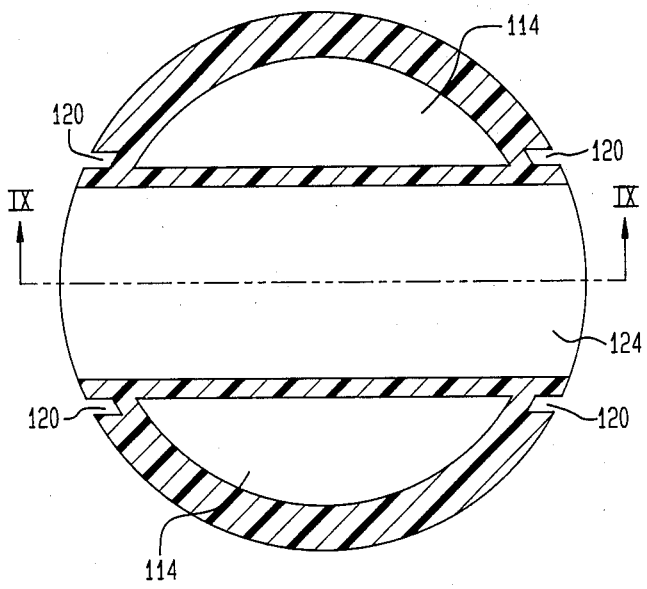
FIG. 8 is a cross-sectional view of the booster valve illustrated in FIG. 7, the section being taken along line VIII—VIII in FIG. 9.
Figure 9:
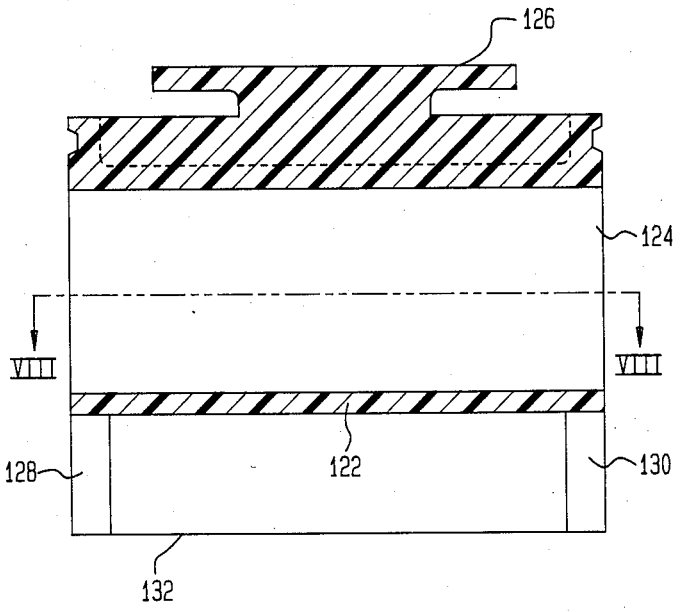
FIG. 9 is a cross-sectional view of the booster valve illustrated in FIG. 7, the section being taken along line IX—IX in FIG. 8.

FIGS. 7–9 illustrate a sliding, diverter-type booster valve 110 which is adapted for use in a skimmer housing (not shown) similar to the skimmer housing 14 illustrated in FIGS. 1, 2 and 4–6. More particularly, the booster valve 110 includes a cylindrical casing 112 which is provided with an interior channel 114. A circular groove 116 extends around the casing 112 adjacent to an upper edge 118 thereof. The groove 116 is sized and shaped so as to releasably receive locking members (not shown), such as the lugs 48 provided on the resilient fingers 50 of the valve body 18 illustrated in FIGS. 2, 4 and 5. Vertical grooves 120 cooperate with mating ribs (not shown) provided on an associated valve body (not shown) to fix the radial orientation of the booster valve 110 relative to the valve body. Thus, the grooves 120 replace the openings 46 employed by the booster valve 40 of FIGS. 2–6. A tubular conduit 122 extends diametrically across the channel 114 of the booster valve 110. The conduit 122 is provided with a passageway 124 adapted to permit the flow of water through the conduit 122. A handle 126 extends upwardly from the conduit 122. Cutouts 128, 130, are provided in a lower edge 132 of the casing 112 directly below the conduit 122.

When the booster valve 110 is in its booster-on position, the cutout 128 is aligned with a passageway (not shown) of a nozzle inlet fitting (not shown) similar to the nozzle inlet fitting 26, while the cutout 130 is aligned with a passageway (not shown) of a nozzle outlet fitting (not shown) similar to the nozzle outlet fitting 28. In its booster-on position, the booster valve 110 is maintained in an elevated condition within its associated valve body (not shown) through the cooperation of the locking members (not shown) and the groove 116. The operation of the booster valve 110 in its booster-on position is essentially identical to the operation of the booster valve 40 when it is in its booster-on position.

The handle 126 can be conveniently employed to manually lower the booster valve 110 from its booster-on position to its booster-off position. When the booster valve 110 is in its booster-off position, the passageway 124 extending through the conduit 122 communicates, at one end, with the passageway (not shown) of the nozzle inlet fitting (not shown), and, at an opposite end, with the passageway (not shown) of the nozzle outlet fitting (not shown). Because the passageway 124 and hence the water flowing therethrough are isolated from the channel 114 and hence the water flowing therethrough, the venturi nozzle system formed by the nozzle inlet fitting and the nozzle outlet fitting cannot be employed to entrain additional pool or spa water.

Figure 10:
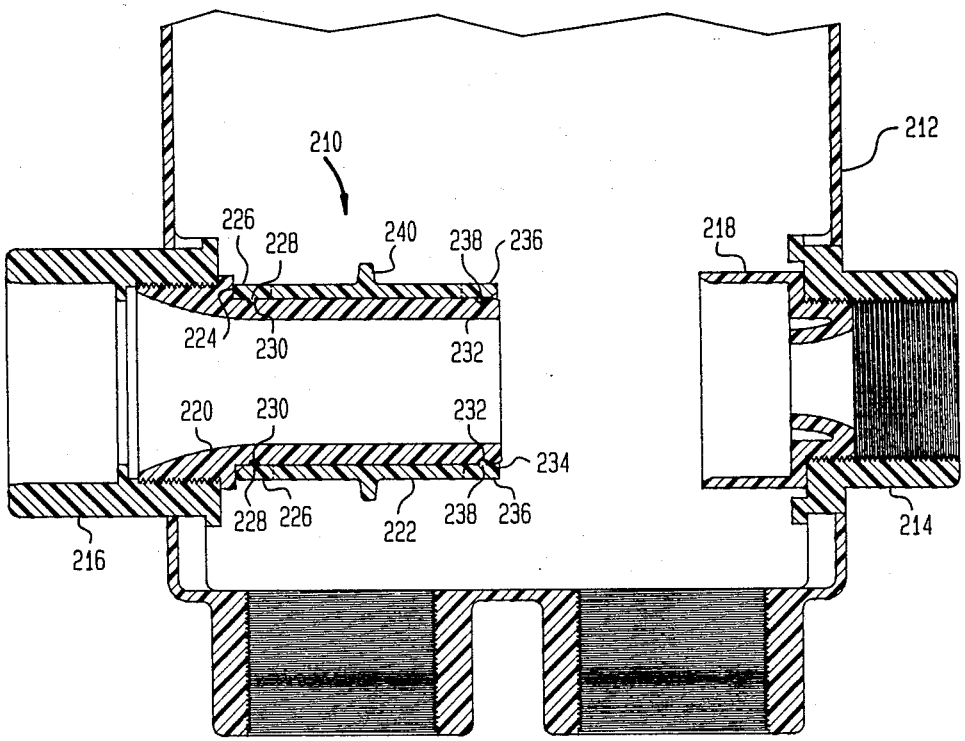
FIG. 10 is a cross-sectional view of another skimmer equipped with a booster valve constructed in accordance with a further embodiment of the present invention, the valve being shown in a booster-on position.
Figure 11:
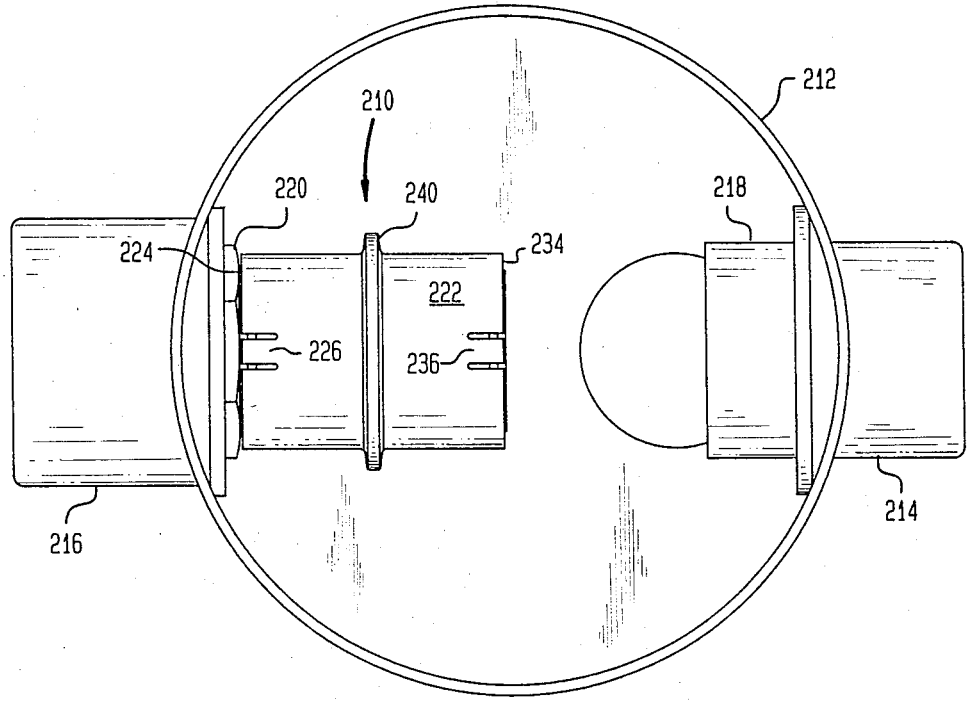
FIG. 11 is a top plan view of the skimmer illustrated in FIG. 10.
Figure 12:
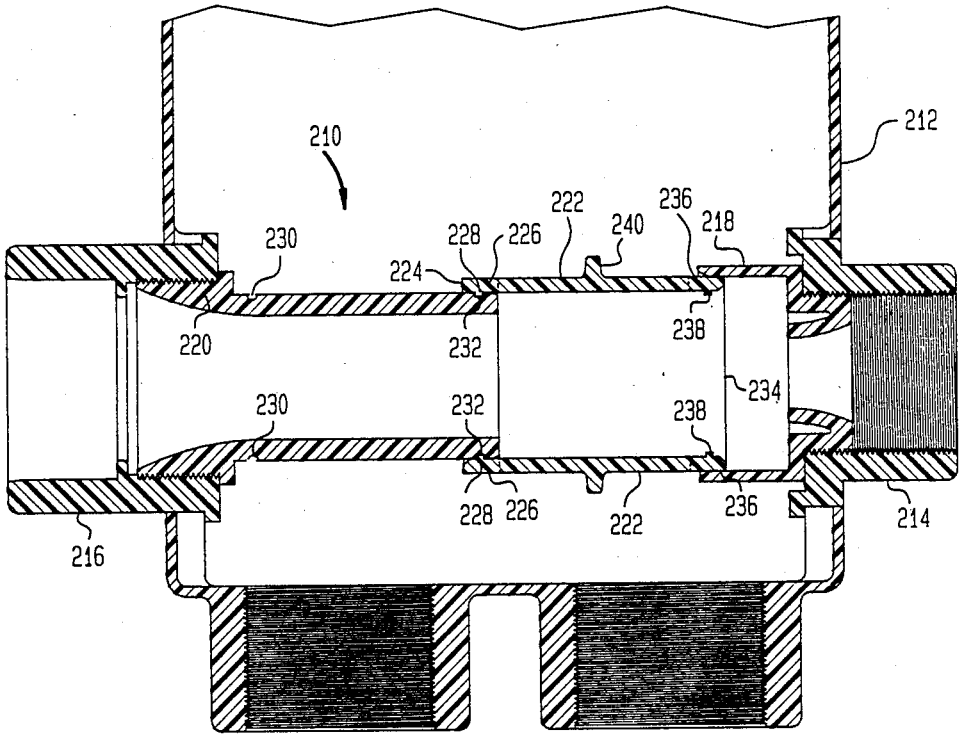
FIG. 12 is a cross-sectional view similar to FIG. 10 except that the booster valve is in a booster-off position.

FIGS. 10–12 illustrate a booster valve 210 adapted for use in a skimmer housing 212 which need not be provided with a valve body similar to the valve body 18. More particularly, the skimmer housing 212 includes an inlet 214 located on one side thereof and an outlet 216 located on an opposite side thereof. A nozzle inlet fitting 218 is threadedly attached to the inlet 214, while a nozzle outlet fitting 220 is threadedly attached to the outlet 216. The nozzle inlet fitting 218 and the nozzle outlet 220 are similar in construction and operation to the nozzle inlet fitting 26 and the nozzle outlet fitting 28, respectively. A cylindrical sleeve 222 is slideably mounted on the nozzle outlet fitting 220. One end 224 of the sleeve 222 is provided with resilient fingers 226 having lugs 228 which are adapted to releasably engage circular grooves 230, 232 provided in the nozzle outlet fitting 220. An opposite end 234 of the sleeve 222 is provided with resilient fingers 236 having lugs 238 which are adapted to releasably engage the groove 232 provided in the nozzle outlet fitting 220. The sleeve 222 also includes a ring 240 which permits the sleeve 222 to be manually gripped and slid between a retracted position (see FIGS. 10 and 11) and an extended position (see FIG. 12).

When the booster valve 210 is in its booster-on position, the sleeve 222 is in its retracted position in which the lugs 228 on the resilient fingers 226 engage the groove 230 in the nozzle outlet fitting 220 and in which the lugs 238 on the resilient fingers 236 engage the groove 232 in the nozzle outlet fitting 220, the lugs 228, 238 cooperating with the grooves 230, 232 to maintain the sleeve 222 in its retracted position. The operation of the booster valve 210 in its booster-on position is essentially identical to the operation of the booster valves 40, 110 when they are in their booster-on positions.

When the booster valve 210 is in its booster-off position, the sleeve 222 is in its extended position in which the lugs 228 on the resilient fingers 226 engage the groove 232 in the nozzle outlet fitting 220 and in which the end 234 of the sleeve 222 is received within the nozzle inlet fitting 218, the lugs 228 cooperating with the groove 232 to maintain the sleeve 222 in its extended position. Because the sleeve 222 isolates the water flowing therethrough from the water flowing through the skimmer housing 212, the venturi nozzle system formed by the nozzle inlet fitting 218 and the nozzle outlet fitting 220 is rendered inoperative for the purpose of entraining additional pool or spa water.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

We claim:

1. A skimmer for skimming water from a swimming pool or spa, comprising entraining means for entraining additional water from the pool or spa to thereby increase the flow of water into and out of the skimmer, said entraining means including a first nozzle member and a second nozzle member, said first and second nozzle members cooperating with each other to jet an entraining stream of water through the skimmer, and isolating means for isolating the entraining stream of water from the rest of the water flowing through the skimmer, said isolating means including actuating means for selectively actuating and deactuating said isolating means, whereby the skimmer can be operated at a first flow rate when said isolating means is actuated and at a second flow rate, which is greater than the first flow rate, when said isolating means is deactuated.

2. A skimmer according to claim 1, further comprising an interior chamber, said chamber communicating with said first and second nozzle members and having supplying means for supplying pool or spa water to said chamber and discharging means for discharging pool or spa water from said chamber.

3. A skimmer according to claim 2, wherein said supplying means is an inlet formed in an upper end of said chamber and said discharging means is an outlet formed in a lower end of said chamber.

4. A skimmer according to claim 3, wherein said first nozzle member is located on one side of said chamber and said second nozzle member is located on an opposite side of said chamber.

5. A skimmer according to claim 4, wherein said actuating means includes a valve, said valve having an inlet opening and an outlet opening and being rotatably received in said chamber such that said valve is rotatable between a first position in which said inlet opening communicates with said first nozzle member and in which said outlet opening communicates with said second nozzle member and a second position in which said inlet opening does not communicate with said first nozzle member and in which said outlet opening does not communicate with said second nozzle member, said isolating means being actuated when said valve is in its said second position and deactuated when said valve is in its said first position.

6. A skimmer according to claim 5, wherein said valve has an open upper end which is in constant communication with said inlet of said chamber and an open lower end which is in constant communication with said outlet of said chamber, whereby spa or pool water flowing through said chamber flows through said valve regardless of whether said valve is in its said first position or its said second position.

7. A skimmer according to claim 6, wherein said valve includes a recessed portion intermediate said upper and lower ends thereof, said recessed portion cooperating with said chamber to form an annular passageway which connects said first and second nozzle members to each other when said valve is in its said second position, whereby water flowing from said first nozzle member to said second nozzle member is diverted around said valve when said valve is in its said second position.

8. A skimmer according to claim 7, wherein said inlet opening of said valve is formed in a nozzle inlet extension which projects radially inwardly and outwardly from said recessed portion and said outlet opening of said valve is formed in a nozzle outlet extension which projects radially inwardly and outwardly from said recessed portion.

9. A skimmer according to claim 8, wherein said nozzle outlet extension is funnel-shaped, the widest portion of said nozzle outlet extension being located within said valve.

10. A skimmer according to claim 9, further comprising locking means for releaseably and selectively locking said valve in its said first and second positions.

11. A skimmer according to claim 10, wherein said locking means includes an annular groove formed in an upper portion of said valve, a plurality of openings provided in said groove and extending through said upper portion of said valve, and at least one resilient finger formed in an upper edge of said chamber and having a lug which is releaseably received within said groove so as to releaseably and selectively engage said openings in response to the rotation of said valve relative to said chamber.

12. A skimmer according to claim 5, wherein said valve includes a handle sized and shaped such that it can be gripped for the purpose of manually rotating said valve between its said first and second positions.

13. A skimmer according to claim 4, wherein said actuating means includes a valve, said valve having an inlet opening and an outlet opening and being slideably received in said chamber such that said valve is slideable between a first position in which said inlet opening communicates with said first nozzle member and in which said outlet opening communicates with said second nozzle member and a second position in which said inlet opening does not communicate with said first nozzle member and in which said outlet opening does not communicate with said second nozzle member, said isolating means being actuated when said valve is in its said first position and deactuated when said valve is in its said second position.

14. A skimmer according to claim 13, wherein said valve has an open upper end which is in constant communication with said inlet of said chamber and an open lower end which is in constant communication with said outlet of said chamber, whereby spa or pool water flowing through said chamber flows through said valve regardless of whether said valve is in its said first position or its said second position.

15. A skimmer according to claim 14, wherein said valve includes a conduit extending between said inlet opening and said outlet opening such that when said valve is in its said first position, water flowing from said first nozzle member to said second nozzle member flows through said conduit without being mixed with spa or pool water flowing through said valve from said upper end thereof to said lower end thereof.

16. A skimmer according to claim 15, further comprising locking means for releaseably and selectively locking said valve in its said first and second positions.

17. A skimmer according to claim 16, wherein said locking means includes an annular groove formed in an upper portion of said valve and at least one resilient finger formed in an upper edge of said chamber and having a lug which is releaseably received within said groove.

18. A skimmer according to claim 13, wherein said valve includes a handle sized and shaped such that it can be gripped for the purpose of manually sliding said valve between its said first and second positions.

19. A skimmer according to claim 4, wherein said first and second nozzle members extend radially into said chamber.

20. A skimmer according to claim 19, wherein said actuating means includes a valve mounted for reciprocating movement on said first nozzle member between an extended position in which said valve extends between said first nozzle member and said second nozzle member, whereby water flowing from said first nozzle member to said second nozzle member flows through said valve without being mixed with spa or pool water flowing through said chamber from said inlet thereof to said outlet thereof, and a retracted position in which said valve does not extend between said first nozzle member and said second nozzle member, whereby water flowing from said first nozzle member to said second nozzle member mixes with spa or pool water flowing through said chamber from said inlet thereof to said outlet thereof, said isolating means being actuated when said valve is in its said extended position and said isolating means being deactuated when said valve is in its said retracted position.

21. A skimmer according to claim 20, wherein said valve includes a cylindrical sleeve which is arranged coaxially with respect to said first and second nozzle members.

22. A skimmer according to claim 21, wherein said sleeve includes locking means for releaseably locking said sleeve in its said extended and retracted positions.

23. A skimmer according to claim 22, wherein said locking means includes a first set of resilient fingers on one end of said sleeve, a second set of resilient fingers on an opposite end of said sleeve, a first annular groove extending around said first nozzle member and a second annular groove extending around said first nozzle member, said first and second grooves being positioned such that when said sleeve is in its said retracted position said fingers of said first set of resilient fingers releaseably engage said first groove and said fingers of said second set of resilient fingers releaseably engage said second groove and such that when said sleeve is in its said extended position said fingers of said first set of fingers releaseably engage said second groove.

24. A skimmer according to claim 20, wherein said valve includes a handle sized and shaped such that it can be gripped for the purpose of manually sliding said valve between its said extended and retracted positions.

* * * * *